US008294653B2

(12) United States Patent
Nakayama

(10) Patent No.: US 8,294,653 B2
(45) Date of Patent: Oct. 23, 2012

(54) DISPLAY PANEL DRIVING VOLTAGE OUTPUT CIRCUIT

(75) Inventor: Akira Nakayama, Tokyo (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 527 days.

(21) Appl. No.: 12/618,806

(22) Filed: Nov. 16, 2009

(65) Prior Publication Data

US 2010/0128018 A1 May 27, 2010

(30) Foreign Application Priority Data

Nov. 21, 2008 (JP) ..... 2008-297935

(51) Int. Cl.
*G09G 5/00* (2006.01)

(52) U.S. Cl. ..... 345/96; 345/98

(58) Field of Classification Search ..... None
See application file for complete search history.

(56) References Cited

U.S. PATENT DOCUMENTS

| | | | | |
|---|---|---|---|---|
| 5,973,660 | A * | 10/1999 | Hashimoto | 345/98 |
| 6,331,846 | B1 * | 12/2001 | Nakao | 345/96 |
| 7,551,030 | B2 * | 6/2009 | An et al. | 330/255 |
| 2009/0040165 | A1 * | 2/2009 | Shimatani | 345/98 |

FOREIGN PATENT DOCUMENTS

JP 10-062744 3/1998

* cited by examiner

*Primary Examiner* — Joseph Haley
(74) *Attorney, Agent, or Firm* — Volentine & Whitt, PLLC

(57) ABSTRACT

A driving voltage output circuit for a matrix display panel includes high-side voltage followers and low-side voltage followers. Each voltage follower includes a differential input stage, a control stage, and an output stage. The differential input stage receives non-inverting and inverting inputs and produces first and second potentials. The control stage generates third and fourth potentials from the first and second potentials. The output stage includes three transistors connected respectively to the high-side power supply, the low-side power supply, and an intermediate reference potential, and connected in common to an output terminal. Two of the three transistors are of identical channel type and are controlled by the first and fourth potentials. The third transistor is of the opposite conductive type and is controlled by the third potential.

8 Claims, 8 Drawing Sheets

DISPLAY PANEL DRIVING VOLTAGE OUTPUT CIRCUIT

BACKGROUND OF THE INVENTION

1. Field of the Invention

The present invention relates to a driving voltage output circuit for a display panel such as an active matrix liquid crystal panel.

2. Description of the Related Art

Alternate current (AC) driving is known to be a necessary condition for maintenance of the long-term reliability of liquid crystal panels. U.S. Pat. No. 5,973,660 to Hashimoto (Japanese Patent Application Publication No. 10-062744, now Japanese Patent No. 3056085) describes a drive circuit with high-voltage circuits for generating and selecting driving voltages above a common reference potential and separate low-voltage circuits for generating and selecting driving voltages below the common reference potential. The drive circuit also includes switches that can route the image data for each column of pixels through either the high-voltage or the low-voltage circuits. The switches enable odd-numbered columns to be driven high while even-numbered columns are driven low, or even-numbered columns to be driven high while odd-numbered columns are driven low. Various AC driving schemes are employed: in frame inversion, the switches change once per frame; in one-line dot inversion, the switches change once per line; in two-line dot inversion, the switches change once every two lines.

This driving method conserves power and enables both the high and low driving voltages to be pre-tailored to the gamma curve of the liquid crystal.

The high- and low-voltage circuits also include operational amplifiers operating as voltage followers that output the selected driving voltages on the selected signal lines. The operational amplifiers shown in U.S. Pat. No. 5,973,660 (FIGS. 10 and 11) have a simple circuit configuration consisting of a differential input stage and a single-ended output stage. The output stage includes a field-effect transistor with its source connected to the power supply or ground, its gate connected to the differential input stage, and its drain connected to the output terminal. The drain is also connected through a current source to the reference potential.

A problem with this amplifier circuit is its slow response, due to the limited gain of the differential input stage and the fixed behavior of the current source in the output stage. The slow response is particularly noticeable when the driving voltage must be shifted toward the reference potential.

SUMMARY OF THE INVENTION

An object of the present invention is to provide a faster-operating driving voltage output circuit for a display panel.

The invention provides a driving voltage output circuit with a plurality of high-side voltage followers and a plurality of low-side voltage followers. The high-side voltage followers output driving voltages equal to or greater than a reference potential and equal to or less than a high-side power supply potential. The low-side voltage followers output driving voltages equal to or greater than a low-side power supply potential and equal to or less than the reference potential. The output driving voltages are supplied to column lines in a matrix display panel responsive to display data. Each column line is switched periodically between receiving a driving voltage from one of the high-side voltage followers and receiving a driving voltage from one of the low-side voltage followers.

Each of the high-side voltage followers and each of the low-side voltage followers includes a differential input stage, a control stage, and an output stage.

The differential input stage has an inverting input terminal, a non-inverting input terminal, a first transistor with a control terminal connected to the non-inverting input terminal, a second transistor with a control terminal connected to the inverting input terminal, and a first current mirror connected to controlled terminals of the first and second transistors to supply the second transistor with a current equal to the current conducted by the first transistor. The first and second transistors operate as a differential amplifier, generating a first potential at a node at which the first transistor and the first current mirror are interconnected and a second potential at a node at which the second transistor and the first current mirror are interconnected.

The control stage includes a potential generating circuit that generates a third potential responsive to the difference between the first potential and the second potential, a third transistor with a control terminal receiving the first potential, and a current output element connected in series with the third transistor between a terminal supplying the high-side power supply potential and a terminal supplying the low-side power supply potential. A fourth potential is generated at a node at which the third and transistor and the current output element are mutually interconnected.

The output stage includes fourth and fifth transistors of identical channel type and a sixth transistor of the opposite channel type. The control terminals of the fourth, fifth, and sixth transistors receive the first potential, the fourth potential, and the third potential, respectively. One controlled terminal of each of the fourth, fifth, and sixth transistors is connected to the output terminal of the voltage follower. In the high-side voltage followers, the other controlled terminals of the fourth, fifth, and sixth transistors receive the high-side power supply potential, the reference potential, and the low-side power supply potential, respectively. In the low-side voltage followers, the other controlled terminals of the fourth, fifth, and sixth transistors receive the low-side power supply potential, the reference potential, and the high-side power supply potential, respectively.

The control stage provides additional gain for charging and discharging the gate of the fifth transistor in the output stage, enabling this transistor to respond quickly to changes in the potentials input to the differential input stage. The driving voltage therefore quickly reaches the level corresponding to the display data. The sixth transistor in the output stage is free of back-gate bias effects and can quickly pull the output voltage even to levels close to the reference potential.

DETAILED DESCRIPTION OF THE INVENTION

Figure 1:
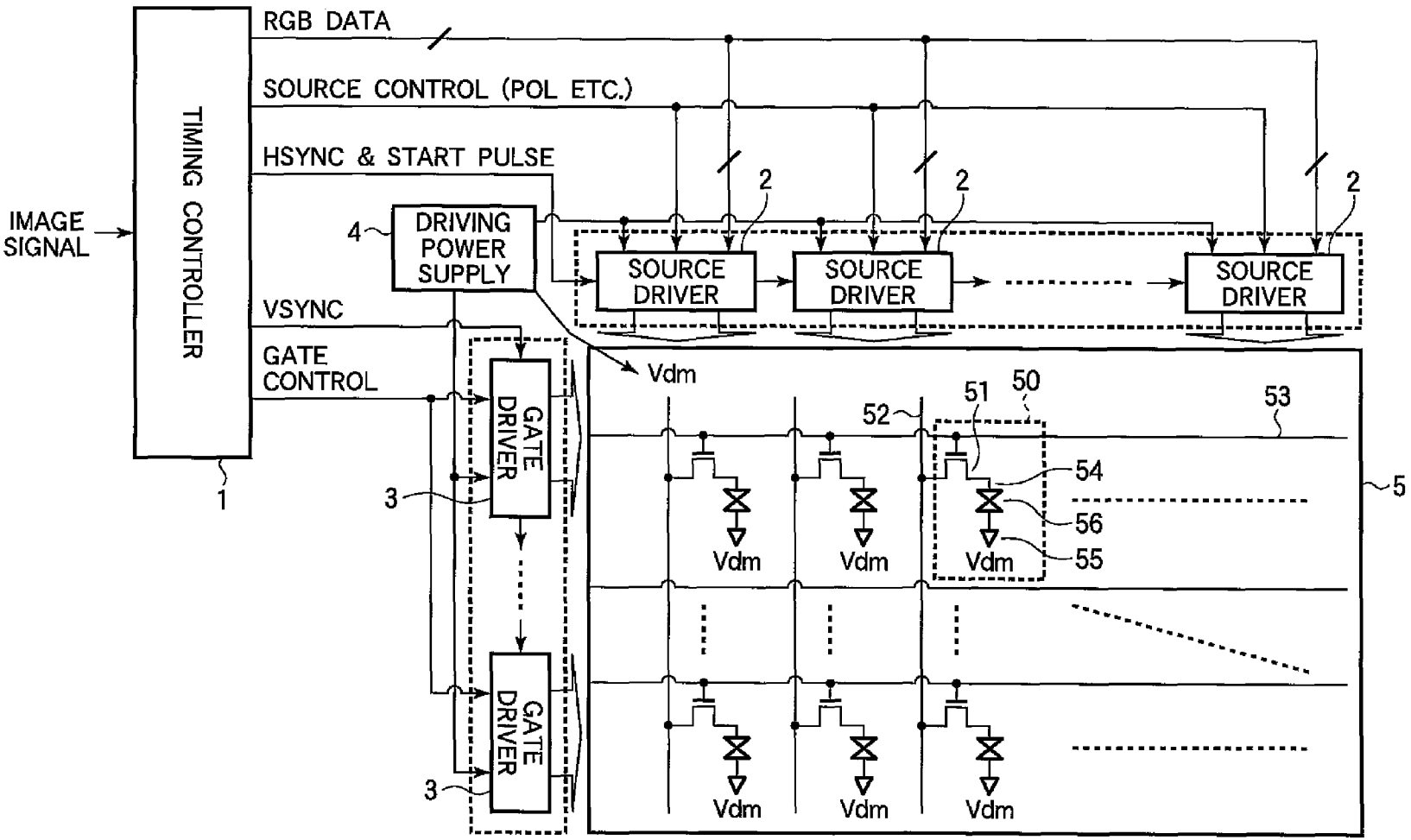
FIG. 1 is a block diagram of a liquid crystal display apparatus employing a driving voltage output circuit according to the present invention.

An embodiment of the invention will now be described with reference to the attached drawings, in which like elements are indicated by like reference characters. In the description, the controlled terminals of a field-effect transistor will be referred to as its source and drain, and the control terminal of a field-effect transistor will be referred to as its gate.

Referring to FIG. 1, the embodiment is used in a liquid crystal display apparatus comprising a timing controller 1, a plurality of source drivers 2, a plurality of gate drivers 3, a driver power supply 4, and a thin-film transistor (TFT) liquid crystal panel 5. The source drivers 2 are cascaded to operate as a single source driver and the gate drivers 3 are cascaded to operate as a single gate driver, as indicated by the encircling dotted lines.

The driver power supply 4 outputs the high-side power supply potential Vdd, the low-side power supply potential Vss, and the reference potential Vdm, which is typically equal to (Vdd−Vss)/2. The driver power supply 4 also outputs a set of potentials grading from Vdm to Vss and a symmetrically opposite set of potentials grading from Vdm to Vss. Exemplary values of Vss, Vdm, and Vdd are 0 V, 5 V, and 10 V, respectively. Vss (0 V) will also be referred to below as the ground potential, and Vdd as the power supply potential.

In the subsequent description and the drawings, Vdd, Vss, and Vdm will also be used to denote terminals that receive these potentials from the driver power supply 4.

The TFT liquid crystal panel 5 includes a plurality of TFTs 51 connected to source signal lines 52, which extend vertically across the panel, and gate signal lines 53, which extend horizontally across the panel. Each TFT 51 is part of a pixel cell that also includes a pixel electrode 54, a common electrode 55, and a liquid crystal element 56. The TFT 51 has source and drain terminals connected to the pixel electrode 54 and one of the source signal lines 52, and a gate terminal connected to one of the gate signal lines 53. The liquid crystal element 56 is disposed between the pixel electrode 54 and the common electrode 55. The common electrodes 55 of all the cells are connected to common lines through which they receive the reference potential Vdm.

The timing controller 1 receives an image signal from an external circuit such as a graphics processor, outputs a vertical synchronizing signal (VSYNC) and gate control signals to the gate drivers 3, and outputs a horizontal synchronizing signal (HSYNC) and start pulse and source control signals to the source drivers 2. The horizontal synchronizing signal and start pulse are synchronized to the vertical synchronizing signal. The source control signals include a polarity control signal (POL) which will be described later. The timing controller 1 also outputs digital red-green-blue (RGB) data to the source drivers 2. The digital RGB data are obtained from the input image signal by a conversion process if the image signal is not already in digital RGB form.

The gate drivers 3 are mutually identical integrated circuit (IC) chips that collectively select one of the gate signal lines 53 according to the gate control signals received from the timing controller 1 and output a scanning signal onto the selected gate signal line. The scanning signal is generated from a voltage supplied by the driver power supply 4, and turns on the TFTs 51 connected to the selected source signal line 52.

The source drivers 2 are mutually identical IC chips that simultaneously output driving voltage signals representing pixel gradation levels on the source signal lines 52. The driving voltage signals are generated by selecting voltages generated by the driver power supply 4 according to the digital RGB data provided by the timing controller 1, and are conducted by the TFTs 51 connected to the selected gate signal line 53 to the pixel electrodes 54 of the corresponding cells, in which they modify the transmittance of the liquid crystal elements 56, thereby displaying a line of pixels in the image.

The transmittance of each liquid crystal element 56 changes in response to the potential difference between the driving voltage applied to the pixel electrode 54 and the reference potential Vdm of the common electrode 55. The driving voltages are alternately higher and lower than Vdm. More precisely, the driving voltages are alternately in the high-side range from Vdm to Vdd and the low-side range from Vdm to Vss.

Figure 2:
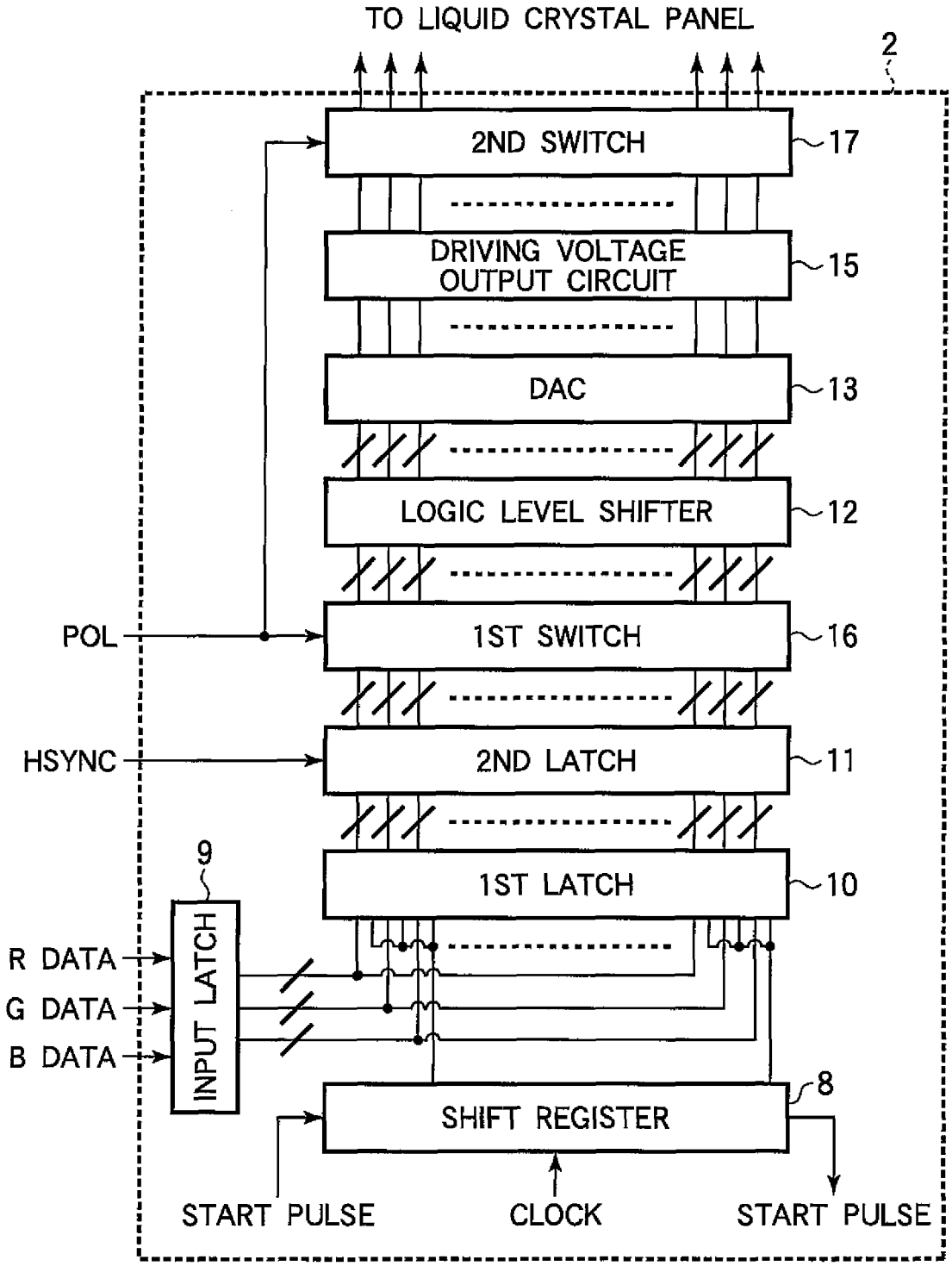
FIG. 2 is a block diagram of the source driver in FIG. 1.

Referring to FIG. 2, each source driver 2 includes a shift register 8, an input latch 9, a first latch circuit 10, a second latch circuit 11, a logic level shifter 12, a digital-to-analog converter (DAC) 13, a driving voltage output circuit 15, a first switch 16, and a second switch 17.

The shift registers 8 in the source drivers 2 are connected in cascade to function as a single shift register through which the start pulse output by the timing controller 1 is shifted in synchronization with a clock signal. The timing controller 1 outputs the digital RGB data in synchronization with the clock signal to the input latches 9 in all the source drivers 2. The shift register 8 controls the first latch circuit 10 in each source driver 2 so that the RGB data for different pixels are latched in different latches, as selected by the current position of the start pulse. When the RGB data for one complete line have been captured in this way, the timing controller 1 outputs a horizontal synchronization signal (HSYNC), causing the second latch circuit 11 in each source driver 2 to latch the captured data. The latched data are then output through the first switch 16 and logic level shifter 12 to the DAC 13 and converted to analog voltage signals. These voltage signals are output through the driving voltage output circuit 15 and second switch 17 to the source signal lines 52. The driving voltage output circuit 15 and second switch 17 are controlled by the polarity control signal (POL) output from the timing controller 1.

Figure 3:
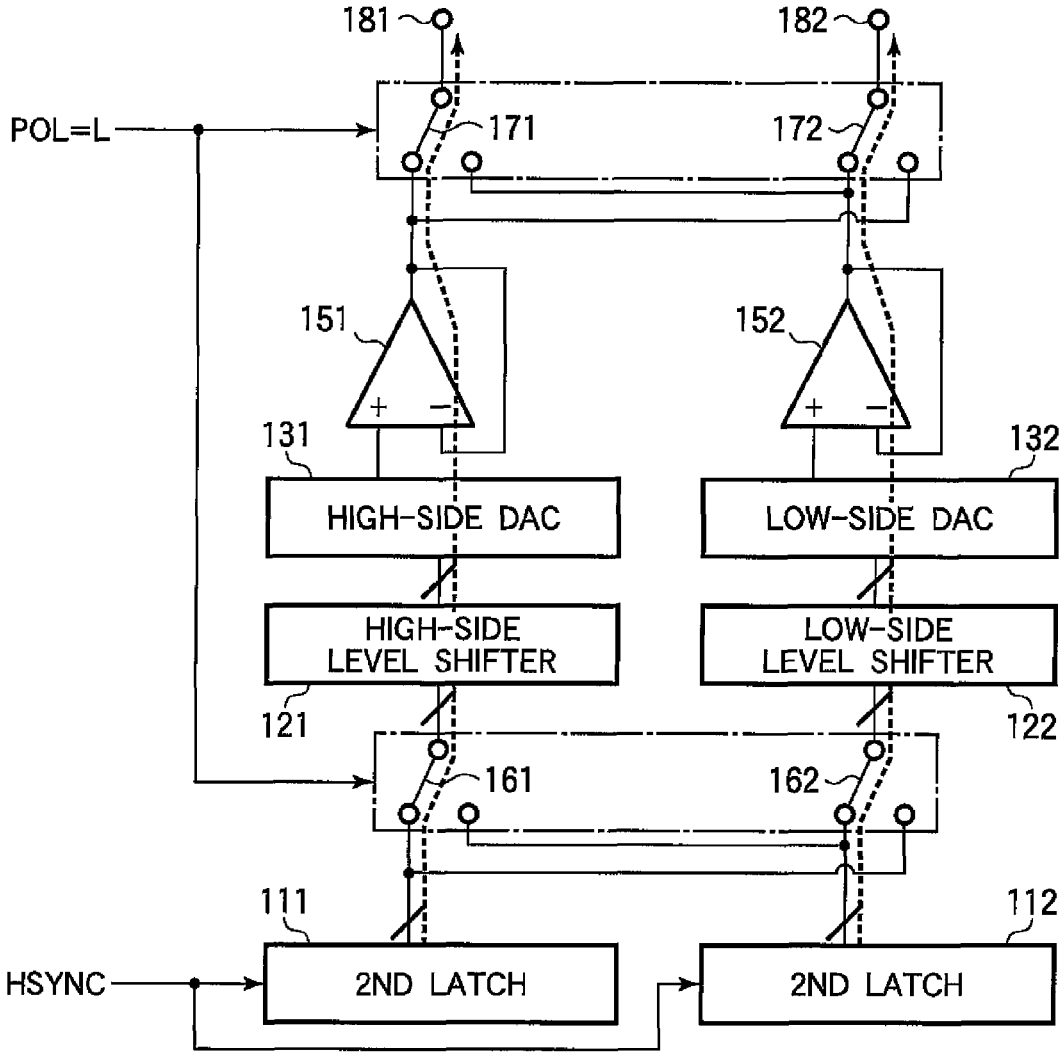
FIGS. 3 and 4 are block diagrams of the source driver circuits connected to an adjacent pair of source lines, illustrating their operation in two different polarity control states.
Figure 4:
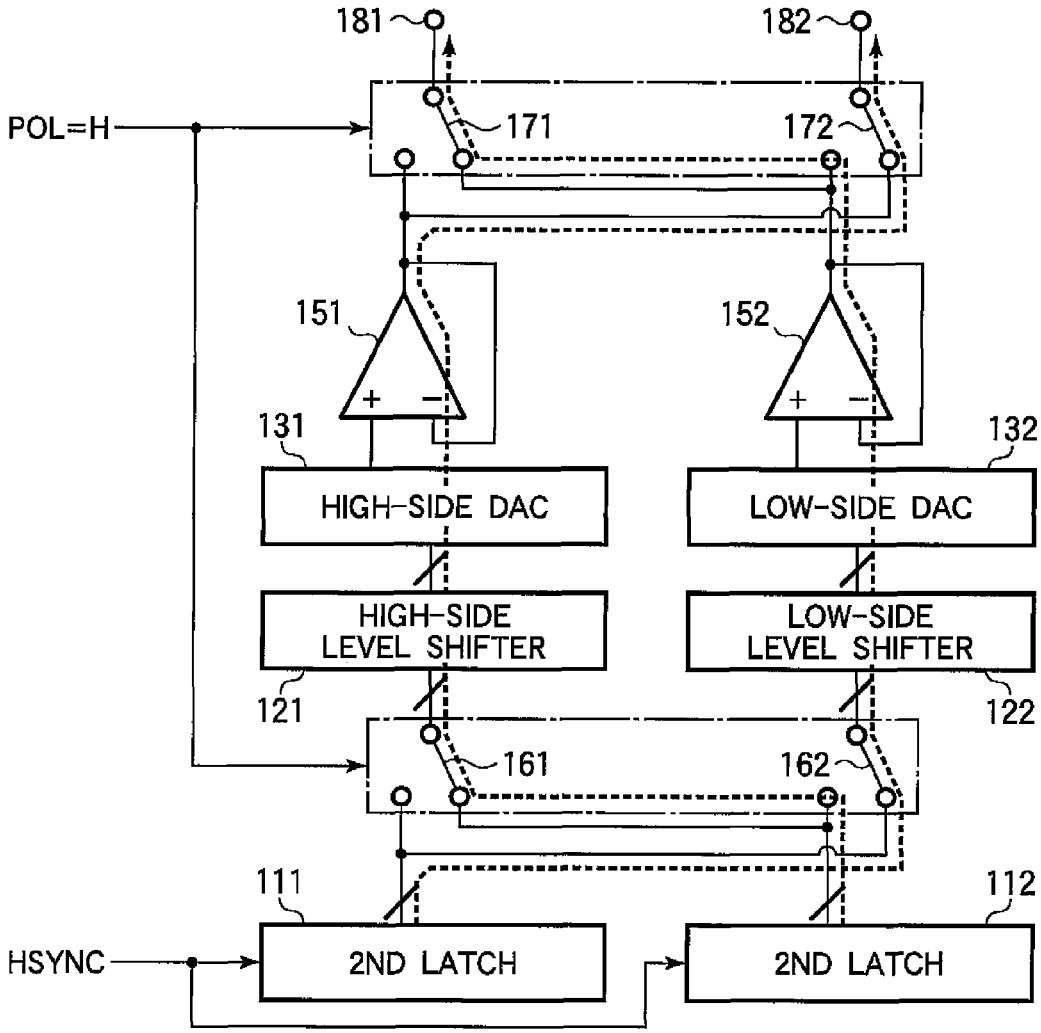

Referring to FIGS. 3 and 4, the circuits that drive a pair of mutually adjacent source signal lines 52 include a pair of latches 111, 112 (both part of the second latch circuit 11 in FIG. 2), a high-side level shifter 121 and a low-side level shifter 122 (both part of the logic level shifter 12 in FIG. 2), a high-side DAC 131 and a low-side DAC 132 (both part of the DAC 13 in FIG. 2), a source amplifier 151 and a sink amplifier 152 (both part of the driving voltage output circuit 15 in FIG. 2), a pair of switches 161, 162 (both part of the first switch 16 in FIG. 2), a pair of switches 171, 172 (both part of the second switch 17 in FIG. 2), an odd-numbered output terminal 181, and an even-numbered output terminal 182.

An odd-numbered source signal line 52 is connected to the odd-numbered output terminal 181. The adjacently following even-numbered source signal line 52 is connected to the even-numbered output terminal 182.

The switches 161, 162, 171, 172 are ganged under control of the polarity control signal POL.

When the polarity control signal POL is at the low logic level (L), the switches are set as shown FIG. 3. The data output from latch 111 are routed through the high-side level shifter 121 to the high-side DAC 131, then (as an analog voltage in the range from Vdm to Vdd) through the source amplifier 151 to the odd-numbered output terminal 181. The data output from latch 112 are routed through the low-side level shifter 122 to the low-side DAC 132, then (as an analog voltage in the range from Vdm to Vss) through the sink amplifier 152 to the even-numbered output terminal 182.

When the polarity control signal POL is at the high logic level (H), the switches are set as shown FIG. 4. The data output from latch 111 are now routed through the low-side level shifter 122 to the low-side DAC 132, then (as an analog voltage equal to or less than Vdm) through the sink amplifier 152 to the odd-numbered output terminal 181. The data output from latch 112 are routed through the high-side level shifter 121 to the high-side DAC 131, then (as an analog voltage equal to or greater than Vdm) through the source amplifier 151 to the even-numbered output terminal 182.

The polarity control signal POL can be controlled to alternate between the high and low logic levels in alternate fields, alternate pixel lines, or alternate pairs of pixel lines for AC driving of the TFT liquid crystal panel 5.

Figure 5:
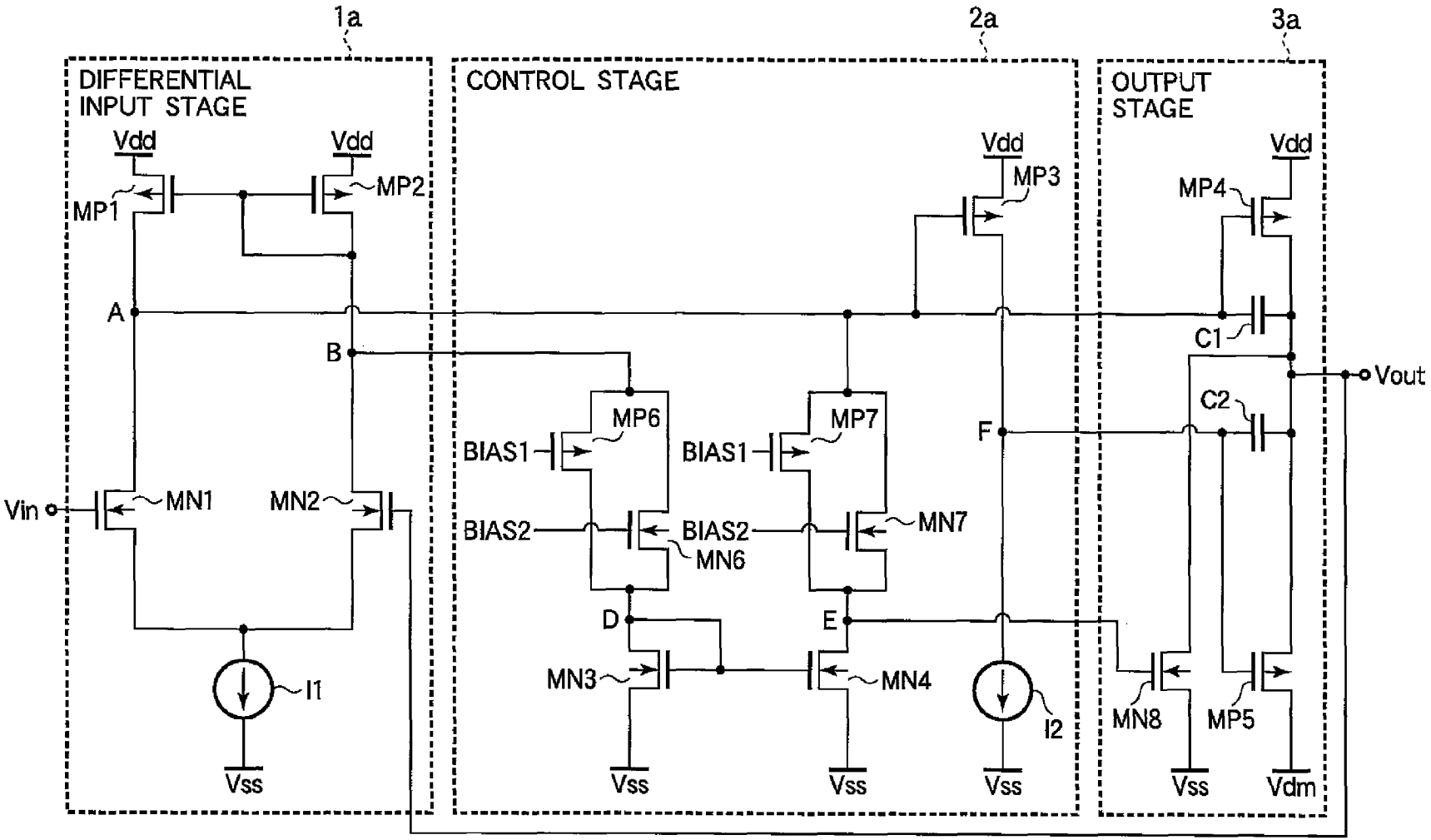
FIG. 5 is a circuit diagram of one embodiment of the source amplifier in FIGS. 3 and 4.

The source amplifier 151 is a high-side voltage follower with the circuit configuration shown in FIG. 5. The output voltage Vout1 of the source amplifier 151 is in the range from the high-side power supply voltage Vdd to the reference voltage Vdm. The sink amplifier 152 is a voltage follower with the circuit configuration shown in FIG. 6. The output voltage Vout2 of the source amplifier 151 is in the range from the reference voltage Vdm to the low-side power supply voltage Vss.

As shown in FIG. 5, the source amplifier 151 has a differential input stage 1*a*, a control stage 2*a*, and an output stage 3*a*. The differential input stage 1*a* includes a pair of n-channel field-effect transistors MN1, MN2 (the first and second transistors), a pair of p-channel field-effect transistors MP1, MP2, and a current source I1, connected to operate as a differential amplifier.

The gate of transistor MN1 functions as the non-inverting input terminal Vin of the source amplifier 151. The control terminal or gate of transistor MN2 functions as the inverting input terminal of the source amplifier 151 and receives the output voltage Vout1 of the source amplifier 151 from the output stage 3*a* as feedback. The source terminals of transistors MN1, MN2 are both connected through the current source I1 to Vss, i.e., to a terminal that receives the ground potential Vss from the driver power supply 4. The source terminals of transistors MP1, MP2 are both connected to Vdd, i.e., to a terminal that receives the power supply potential Vdd from the driver power supply 4. The drains of transistors MN1 and MP1 are interconnected at a node A from which the first potential of the source amplifier 151 is taken. The drains of transistors MN1 and MP1 are interconnected at a node B from which the second potential is taken. The gates of transistors MP1 and MP2 are both connected to the drain of transistor MP2, so that transistors MP1 and MP2 operate as a current mirror (the first current mirror).

The control stage 2*a* includes p-channel field-effect transistors MP3, MP6, MP7 and n-channel field-effect transistors MN3, MN4, MN6, and MN7, and a current source I2. Transistors MN3 and MN4 are interconnected to form the second current mirror. Transistor MP3 (the third transistor) is connected in series with the current source between terminals supplying Vdd and Vss. Transistors MP6 and MN6 are connected in parallel between node B and the second current mirror and function as a first current pass circuit or active resistance element. Transistors MP7 and MN7 are connected in parallel between node A and the second current mirror and function as a second current pass circuit or active resistance element.

Specifically, the sources of transistors MN3 and MN4 are both connected to Vss, and their gates are both connected to the drain of transistor MN3 at a node D. The source of transistor MP6 and the drain of transistor MN6 are both connected to node B in the differential input stage 1*a*. The drain of transistor MP6 and the source of transistor MN6 are both connected to node D. The source of transistor MP7 and the drain of transistor MN7 are both connected to node A in the differential input stage 1*a*. The drain of transistor MP7 and the source of transistor MN7 are both connected at a node E to the drain of transistor MN4. The potential of node E is the third potential. A first bias voltage BIAS1 is applied to the gates of transistors MP6 and MN6. A second bias voltage BIAS2 is applied to the gates of transistors MP7 and MN7.

Because of the above interconnections of transistors MP6, MP7, MN3, MN4, MN6, and MN7, the potential of node E varies in response to the potential difference between nodes A and B. The potential of node E is comparatively high when the potential of node A is greater than the potential of node B, and comparatively low when the potential of node A is less than the potential of node B.

Transistor MP3 has its source connected to Vdd, its gate connected to node A in the differential input stage 1*a*, and its drain connected to the current source I2 at a node F. The potential of node F is the fourth potential output from the control stage 2*a*. Current source I2 is connected between node F and Vss and supplies a substantially constant current.

The output stage 3*a* includes p-channel field-effect transistors MP4 and MP5 (the fourth and fifth transistors), an n-channel field-effect transistor MN8 (the sixth transistor), and a pair of phase compensation capacitors C1, C2. Transistor MP4 has its source connected to Vdd and its gate connected to node A. Transistor MP5 has its drain connected to Vdm and its gate connected to node F. The drain of transistor MP4 and the source of transistor MP5 are mutually interconnected and are both connected to the output terminal Vout of the source amplifier 151. Capacitor C1 is connected between the gate and drain of transistor MP4. Capacitor C2 is connected between the gate and source of transistor MP5. Transistor MN8 has its source connected to Vss, its gate connected to node E in the control stage 2*a*, and its drain connected to the output terminal Vout.

The non-inverting input terminal Vin of the source amplifier 151 receives an input potential in the range from the power supply potential Vdd to the reference potential Vdm. Starting from a state in which the output potential Vout1 is equal to the input potential, if the potential at the non-inverting input terminal Vin shifts upward toward Vdd, increasing the gate-source voltage of transistor MN1, transistor MN1 conducts more drain-source current and the potential at node A falls, discharging the gates and increasing the source-drain current flow of transistors MP3 and MP4. Since transistor MP3 has become more conductive, the potential at node F rises, charging the gate and decreasing the source-drain current flow of transistor MP5. The fall in the potential at node A, acting through transistors MP7 and MN7, also reduces the potential at node E and thus the gate-source voltage of transistor MN8, making transistor MN8 conduct less drain-source current. Because of the altered current flows through transistors MP4, MP5, and MN8, the source line 52 connected to the output terminal Vout charges and the potential Vout1 at the output terminal Vout shifts upward toward Vdd.

The increase in the potential at the output terminal Vout increases the gate-source voltage and drain-source current flow of transistor MN2. The potential at node B therefore falls, increasing the flow of source-drain current through transistor MP2. This increased source-drain current flow is mirrored by transistor MP1, raising the potential of node A and reducing the source-drain current flow through transistor MP3. The potential at node F is thereby reduced, increasing the flow of source-drain current through transistor MP5. The fall in the potential at node B, acting through transistors MP6 and MN6, also lowers the potential at node D, reducing the gate-source voltage and drain-source current flow of transistor MN3. The reduced current conductivity of transistor MN3 is mirrored by transistor MN4. The rise in the potential of node A and the reduced conductivity of transistor MN4 combine to raise the potential of node E, increasing the gate-source voltage and drain-source current flow of transistor MN8.

The above process continues until the potentials at nodes A, B, D, E, and F converge to values such that the potential Vout1 at the output terminal Vout is again equal to the potential at the input terminal Vin.

Similarly, if the potential at the non-inverting input terminal Vin shifts downward toward Vdm, decreasing the gate-source voltage of transistor MN1, transistor MN1 conducts less drain-source current and the potential at node A rises, charging the gates and decreasing the source-drain current flow of transistors MP3 and MP4. Since transistor MP3 has become less conductive, the potential at node F falls, discharging the gate and increasing the source-drain current flow of transistor MP5. The rise in the potential at node A, acting through transistors MP7 and MN7, also raises the potential at node E, charging the gate of transistor MN8 so that it conducts more drain-source current. Because of the altered current flows through transistors MP4, MP5, and MN8, the source line 52 connected to the output terminal Vout discharges and the potential Vout1 at the output terminal Vout shifts downward toward Vdm. The downward shift is particularly rapid because much discharge current that would otherwise have to flow through transistor MP5 to Vdm is shunted through transistor MN8 to ground.

The decrease in the potential at the output terminal Vout decreases the gate-source voltage and drain-source current flow of transistor MN2. The potential at node B therefore rises, decreasing the flow of source-drain current through transistor MP2. This decreased source-drain current flow is mirrored by transistor MP1, lowering the potential of node A and increasing the conductivity of transistor MP3. The potential at node F is thereby increased, reducing the source-drain current flow through transistor MP5. The rise in the potential at node B, acting through transistors MP6 and MN6, also raises the potential at node D, increasing the gate-source voltage and drain-source current flow of transistor MN3. The increased current conductivity of transistor MN3 is mirrored by transistor MN4. The fall in the potential of node A and the increased conductivity of transistor MN4 combine to lower the potential of node E, reducing the gate-source voltage and drain-source current flow of transistor MN8.

The above process also continues until the potentials at nodes A, B, D, E, and F converge to values such that the potential Vout1 at the output terminal Vout is equal to the potential at the input terminal Vin.

As the potential of the output terminal Vout falls toward Vdm, transistor MP5 experiences an increasing back-gate bias that reduces its channel conductivity. To obtain adequate response speed near Vdm from transistor MP5 alone, it would be necessary to compensate for the reduced conductivity by making transistor MP5 comparatively large. In contrast, transistor MN8 experiences no such back-gate bias effect, and its drain-source voltage is always at least Vdm, enabling transistor MN8 to discharge the output signal line rapidly, even to potentials close to Vdm. Adequate response speed can therefore be obtained without the need to enlarge transistor MP5.

A further effect of transistor MN8 is that the control stage 2*a* can be designed so that although both transistors MP5 and MN8 conduct current when the output potential is changing, once the output potential stabilizes, transistor MN8 conducts current but transistor MP5 does not. The differential input stage 1*a* and output stage 3*a* then both conduct current between Vdd and Vss, balancing the load on the power supply and reducing the system offset.

Figure 6:
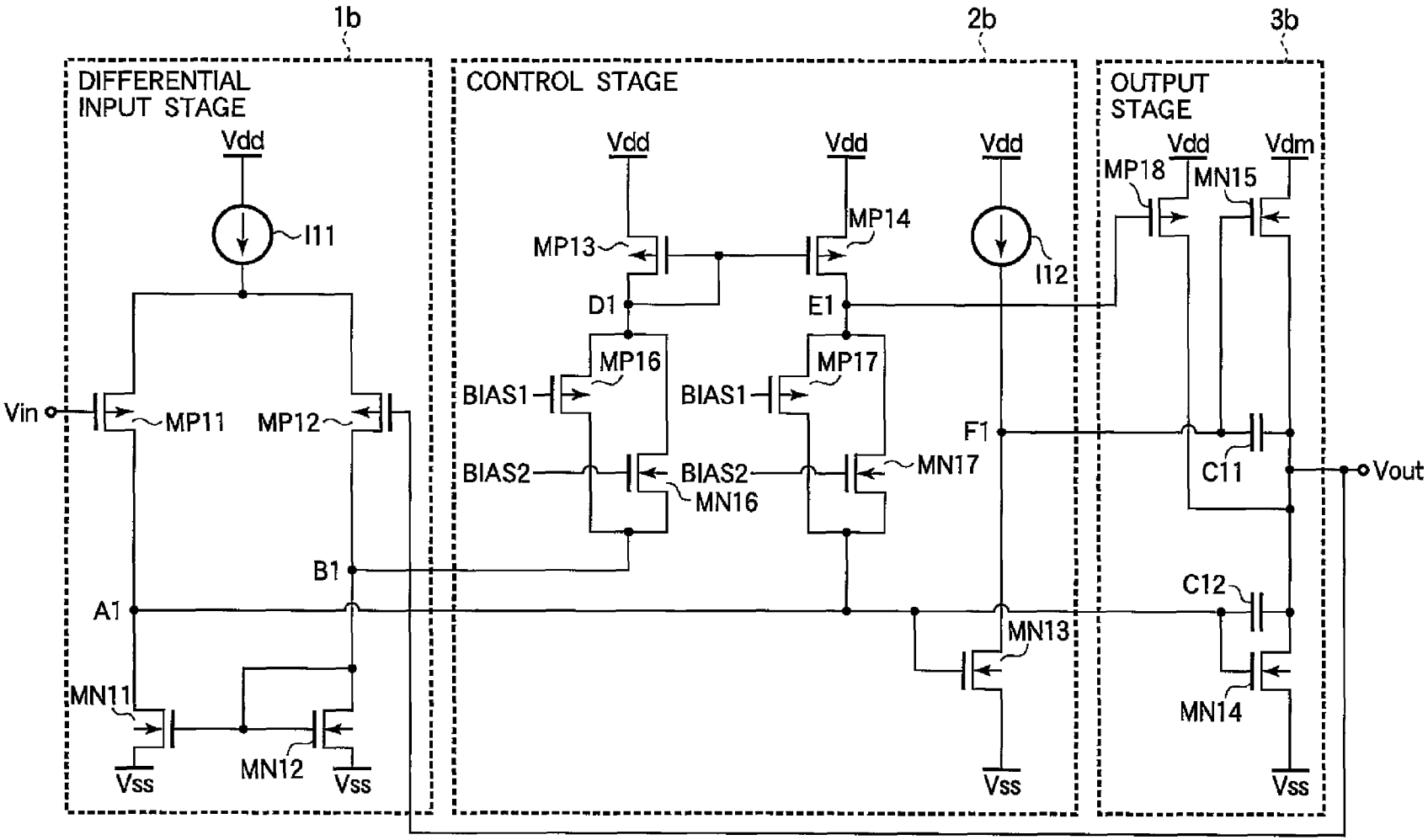
FIG. 6 is a circuit diagram of one embodiment of the sink amplifier in FIGS. 3 and 4.

As shown in FIG. 6, the sink amplifier 152 is symmetrically identical to the source amplifier 151 with the roles of Vdd and Vss interchanged and the channel types of the transistors reversed. The sink amplifier 152 operates as a low-side voltage follower.

Specifically, the sink amplifier 152 has a differential input stage 1*b*, a control stage 2*b*, and an output stage 3*b*. The differential input stage 1*b* includes a pair of p-channel field-effect transistors MP11, MP12 (the first and second transistors), a pair of n-channel field-effect transistors MN11, MN12, and a current source I11, connected to operate as a differential amplifier.

The gate of transistor MP11 functions as the non-inverting input terminal Vin of the sink amplifier 152. The gate of transistor MP12 functions as the inverting input terminal of the sink amplifier 152 and receives the output voltage Vout2 of the sink amplifier 152 from the output stage 3*b* as feedback. The source terminals of transistors MP11, MP12 are both connected through the current source I11 to Vdd. The source terminals of transistors MN11, MN12 are both connected to Vss. The drains of transistors MP11 and MN11 are interconnected at a node A1 from which the first potential of the sink amplifier 152 is taken. The drains of transistors MP11 and MN11 are interconnected at a node B1 from which the second potential is taken. The gates of transistors MN11 and MN12 are both connected to the drain of transistor MN12, so that transistors MN11 and MN12 operate as a current mirror (the first current mirror).

The control stage 2*b* includes n-channel field-effect transistors MN13, MN16, MN17, p-channel field-effect transistors MP13, MP14, MP16, MP17, and a second current source I12. The sources of transistors MP13 and MP14 are both connected to Vdd, and their gates are both connected to the drain of transistor MP13 at a node D1, so that they operate as a second current mirror. The source of transistor MN16 and the drain of transistor MP16 are both connected to node B1 in the differential input stage 1*b*. The drain of transistor MN16 and the source of transistor MP16 are both connected to node D1. The source of transistor MN17 and the drain of transistor MP17 are both connected to node A1 in the differential input stage 1*b*. The drain of transistor MN17 and the source of transistor MP17 are both connected at a node E1 to the drain of transistor MN4. The potential of node E1 is the third potential. A first bias voltage BIAS1 is applied to the gates of transistors MP16 and MP17. A second bias voltage BIAS2 is applied to the gates of transistors MN16 and MN17.

Because of the above interconnections of transistors MN16, MN17, MP13, MP14, MP16, and MP17, the potential of node E1 varies in response to the potential difference between nodes A1 and B1. The potential of node E1 is comparatively high when the potential of node A1 is greater than the potential of node B1, and comparatively low when the potential of node A1 is less than the potential of node B1.

Transistor MN13 (the third transistor) has its source connected to Vss, its gate connected to node A1 in the differential input stage 1*b*, and its drain to a node F1. The potential of node F1 is the fourth potential output from the control stage 2*b*. Current source I12 is connected between Vdd and node F1 and supplies a substantially constant current.

The output stage 3*b* includes n-channel field-effect transistors MN14 and MN15 (the fourth and fifth transistors), a p-channel transistor MP18 (the sixth transistor), and a pair of phase compensation capacitors C11, C12. Transistor MN14 has its source connected to Vss and its gate connected to node A1. Transistor MN15 has its drain connected to the reference potential Vdm and its gate connected to node F1. The drain of transistor MN14 and the source of transistor MN15 are mutually interconnected and are both connected to the output terminal Vout of the sink amplifier 152. Capacitor C11 is connected between the gate and source of transistor MN15. Capacitor C12 is connected between the gate and drain of transistor MN14. Transistor MP18 has its source connected to Vdd, its gate connected to node E1 in the control stage 2*a*, and its drain connected to the output terminal Vout.

The non-inverting input terminal Vin of the sink amplifier 152 receives an input potential in the range from the ground potential Vss to the reference potential Vdm. Starting from a state in which the output potential Vout2 is equal to the input potential, if the potential at the non-inverting input terminal Vin shifts downward toward Vss, increasing the gate-source voltage of transistor MP11, transistor MP11 conducts more source-drain current and the potential at node A1 rises, charging the gates and increasing the drain-source current flow of transistors MN13 and MN14. Since transistor MN13 has become more conductive, the potential at node F1 falls, discharging the gate and decreasing the drain-source current flow of transistor MN15. The rise in the potential at node A1, acting through transistors MN17 and MP17, also raises the potential at node E1 and reduces the gate-source voltage of transistor MP18, making transistor MP18 conduct less source-drain current. Because of the altered current flows through transistors MN14, MN15, and MP18, the source line 52 connected to the output terminal Vout discharges and the potential Vout2 at the output terminal Vout shifts downward toward Vss.

The decrease in the potential at the output terminal Vout increases the gate-source voltage and source-drain current flow of transistor MP12. The potential at node B1 therefore rises, increasing the flow of drain-source current through transistor MN12. This increased drain-source current flow is mirrored by transistor MN11, lowering the potential of node A1 and reducing the drain-source current flow through transistor MN13. The potential at node F1 is thereby increased, increasing the flow of drain-source current through transistor MN15. The rise in the potential at node B1, acting through transistors MN16 and MP16, also raises the potential at node D1, reducing the gate-source voltage and source-drain current flow of transistor MP13. The reduced conductivity of transistor MP13 is mirrored by transistor MP14. The drop in the potential of node A1 and the reduced conductivity of transistor MP14 combine to lower the potential of node E1, increasing the gate-source voltage and source-drain current flow of transistor MP18.

The above process continues until the potentials at nodes A1, E1, D1, E1, and F1 converge to values such that the potential Vout2 at the output terminal Vout is again equal to the potential at the input terminal Vin.

Similarly, if the potential at the non-inverting input terminal Vin shifts upward toward Vdm, decreasing the gate-source voltage of transistor MP11, transistor MP11 conducts less source-drain current and the potential at node A1 falls, discharging the gates and decreasing the drain-source current flow of transistors MN13 and MN14. Since transistor MN13 has become less conductive, the potential at node F1 rises, charging the gate and increasing the drain-source current flow of transistor MN15. The drop in the potential at node A1, acting through transistors MN17 and MP17, also lowers the potential at node E1, discharging the gate of transistor MP18 so that it conducts more source-drain current. Because of the altered current flows through transistors MN14, MN15, and MP18, the source line 52 connected to the output terminal Vout charges and the potential Vout2 at the output terminal Vout shifts upward toward Vdm. The upward shift is particularly rapid because much current that would otherwise have to flow from Vdm through transistor MN15 is shunted from Vdd through transistor MP18.

The rise in the potential at the output terminal Vout decreases the gate-source voltage and source-drain current flow of transistor MP12. The potential at node B1 therefore falls, decreasing the flow of drain-source current through transistor MN12. This decreased drain-source current flow is mirrored by transistor MN11, raising the potential of node A1 and increasing the conductivity of transistor MN13. The potential at node F1 is thereby lowered, reducing the drain-source current flow through transistor MN15. The drop in the potential at node B1, acting through transistors MN16 and MP16, also lowers the potential at node D1, increasing the gate-source voltage and source-drain current flow of transistor MP13. The increased current conductivity of transistor MP13 is mirrored by transistor MP14. The rise in the potential of node A1 and the increased conductivity of transistor MP14 combine to raise the potential of node E1, reducing the gate-source voltage and source-drain current flow of transistor MP18.

The above process continues until the potentials at nodes A1, B1, D1, E1, and F1 converge to values such that the potential Vout2 at the output terminal Vout is equal to the potential at the input terminal Vin.

As the potential of the output terminal Vout rises toward Vdm, transistor MN15 experiences an increasing back-gate bias that reduces its channel conductivity. To obtain adequate response speed near Vdm from transistor MN15 alone, it would be necessary to compensate for the reduced conductivity by making transistor MN15 comparatively large. In contrast, transistor MP18 experiences no such back-gate bias effect, and its drain-source voltage is always at least Vdm, enabling transistor MP18 to discharge the output signal line rapidly, even to potentials close to Vdm. Adequate response speed can therefore be obtained without the need to enlarge transistor MN15.

A further effect of transistor MP18 is that the control stage 2*b* can be designed so that although both transistors MN15 and MP18 conduct current when the output potential is changing, once the output potential stabilizes, transistor MP18 conducts current but transistor MN15 does not. The differential input stage 1*b* and output stage 3*b* then both conduct current between Vdd and Vss, balancing the load on the power supply and reducing the system offset.

Figure 7:
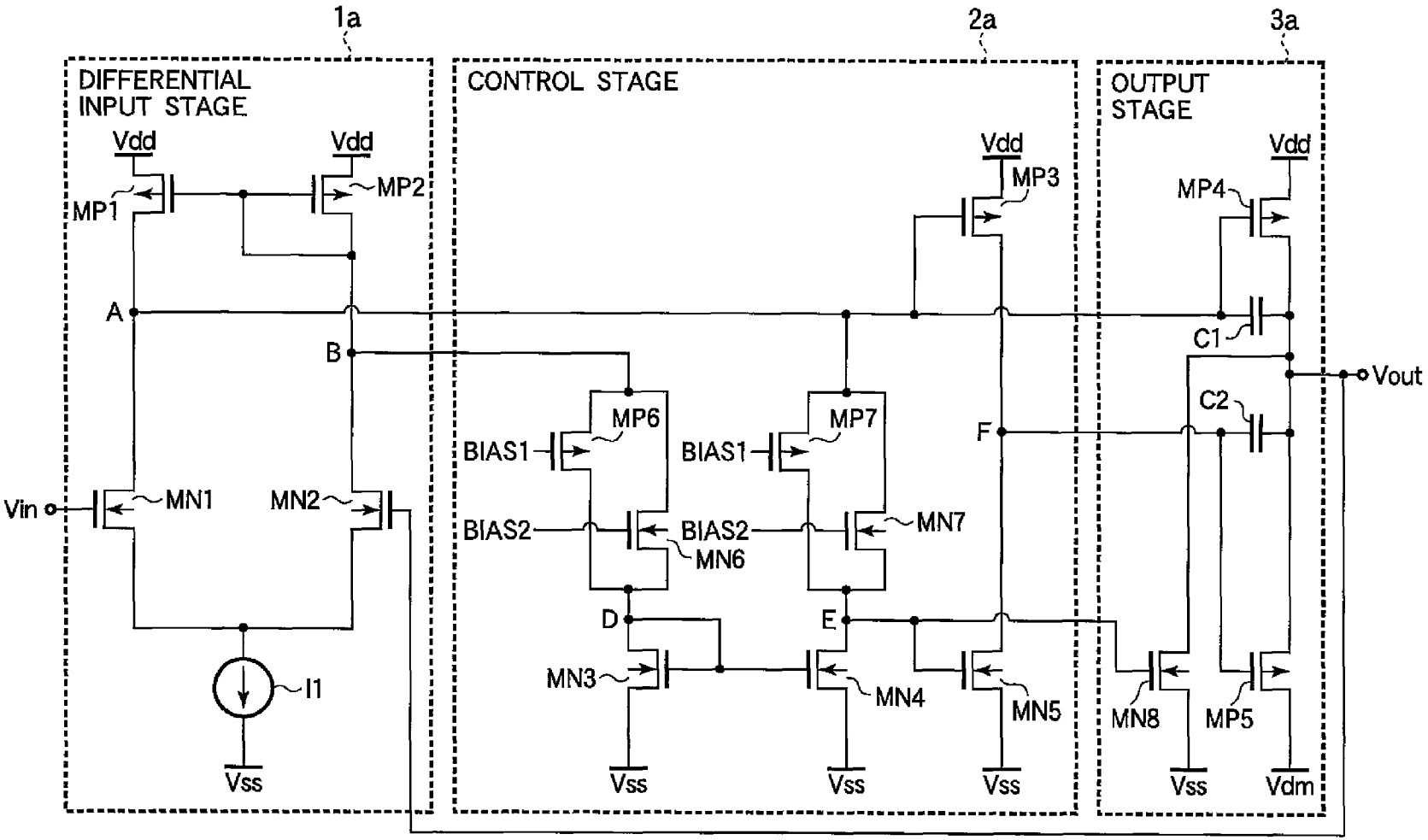
FIG. 7 is a circuit diagram of another embodiment of the source amplifier in FIGS. 3 and 4.
Figure 8:
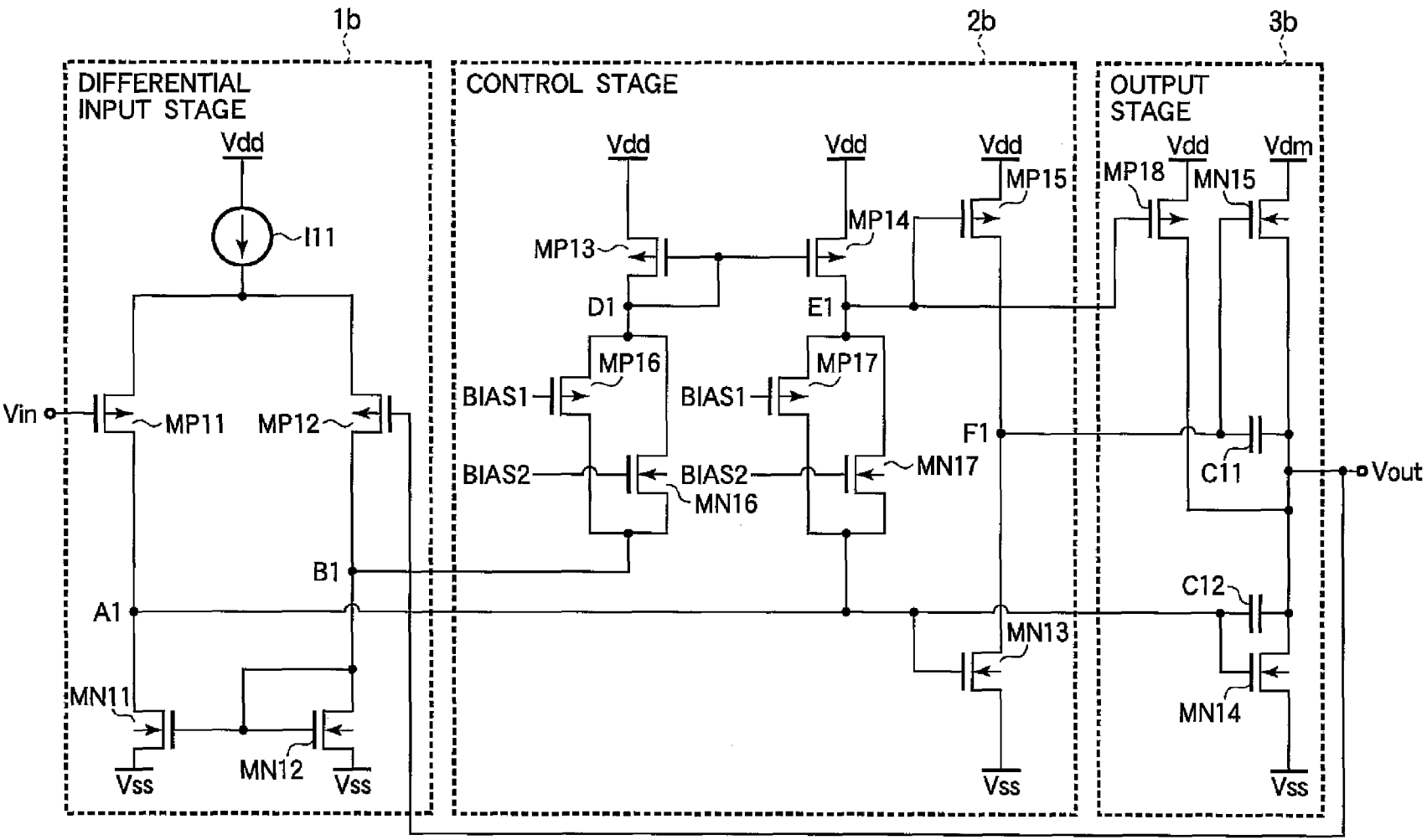
FIG. 8 is a circuit diagram of another embodiment of the sink amplifier in FIGS. 3 and 4.

The control stage 2*a* of the source amplifier 151 can be modified as shown in FIG. 7, by replacing current source I2 with an n-channel field-effect transistor MN5 having its gate connected to node E. Transistors MP3 and MN5 are then connected in a push-pull configuration to produce the fourth potential at node F. Similarly, the control stage 2*a* of the sink amplifier 152 can be modified as shown in FIG. 8, by replacing current source I12 with a p-channel field-effect transistor MP15 having its gate connected to node E1. Transistors MN13 and MP15 are then connected in a push-pull configuration to produce the fourth potential at node F1.

The push-pull configuration of p-channel and n-channel field-effect transistors in these modified control stages 2*a*, 2*b* provides higher gain and current driving capability than the single-ended configuration in FIGS. 5 and 6. The response to changes in the potentials output by the differential input stage is also quick, because neither transistor in the push-pull configuration is every switched completely off. The response speed of the source amplifier 151 and sink amplifier 152 in driving the output potential toward Vdm is thereby further improved.

The invention is not limited to the circuit configurations shown in the drawings. For example, other current pass circuits or resistance elements may be used in place of the parallel p-channel and n-channel transistors MP6 and MN6, MP7 and MN7, MP16 and MN16, and MP17 and MN17 in the control stages 2*a* and 2*b*.

Those skilled in the art will recognize that further variations are possible within the scope of the invention, which is defined in the appended claims.

What is claimed is:

1. A driving voltage output circuit having a plurality of high-side voltage followers and a plurality of low-side voltage followers, the high-side voltage followers outputting driving voltages equal to or greater than a reference potential and equal to or less than a high-side power supply potential, the low-side voltage followers outputting driving voltages equal to or greater than a low-side power supply potential and equal to or less than the reference potential, the driving voltages being supplied to column lines in a matrix display panel responsive to display data, each column line being periodically switched between receiving a driving voltage from one of the high-side voltage followers and receiving a driving voltage from one of the low-side voltage followers, each of the high-side voltage followers and each of the low-side voltage followers separately comprising:

a differential input stage having an inverting input terminal, a non-inverting input terminal, a first transistor with a control terminal connected to the non-inverting input terminal, a second transistor with a control terminal connected to the inverting input terminal, and a first current mirror connected to controlled terminals of the first and second transistors to supply the second transistor with a current equal to a current conducted by the first transistor, the first and second transistors operating as a differential amplifier to generate a first potential at a node at which the first transistor and the first current mirror are interconnected and a second potential at a node at which the second transistor and the first current mirror are interconnected;

a control stage including a potential generating circuit for generating a third potential responsive to a difference between the first potential and the second potential, a third transistor (MP3) with a control terminal receiving the first potential, and a current output element connected in series with the third transistor between a terminal supplying the high-side power supply potential and a terminal supplying the low-side power supply potential to generate a fourth potential at a node at which the third transistor and the current output element are mutually interconnected; and an output stage including a first terminal, a second terminal, a third terminal, an output terminal connected to the inverting input terminal of the input stage and to one of the column lines, a fourth transistor with a control terminal receiving the first potential, a controlled terminal connected to the first terminal, and another controlled terminal connected to the output terminal, a fifth transistor with a control terminal receiving the fourth potential, a controlled terminal connected to the second terminal, and another controlled terminal connected to the output terminal, and a sixth transistor with a control terminal receiving the third potential, a controlled terminal connected to the third terminal, and another controlled terminal connected to the output terminal, the fourth and fifth transistors being of mutually identical channel types, the fourth and sixth transistors being of mutually opposite channel types, the second terminal supplying the reference potential; wherein in the high-side voltage followers the first terminal supplies the high-side power supply potential and the third terminal supplies the low-side power supply potential; and in the low-side voltage followers the first terminal supplies the low-side power supply potential and the third terminal supplies the high-side power supply potential.

2. The driving voltage output circuit of claim 1, wherein:

the control terminals of the third and fourth transistors are connected to the node at which the first transistor and the first current mirror are interconnected; and the control terminal of the fifth transistor is connected to the node at which the third transistor and the current output element are mutually interconnected.

3. The driving voltage output circuit of claim 1, wherein the potential generating circuit in the control stage further comprises:

a first current pass circuit receiving the second potential from the input stage;

a second current pass circuit receiving the first potential from the input stage; and a second current mirror connected to the first and second current pass circuits to supply the second current pass circuit with a current equal to the current conducted by the first current pass circuit, the third potential being generated at a node at which the second current pass circuit and the second current mirror are interconnected.

4. The driving voltage output circuit of claim 3, wherein the control terminal of the sixth transistor is connected to the node at which the second current pass circuit and the second current mirror are interconnected.

5. The driving voltage output circuit of claim 3, wherein:

the first current pass circuit includes a seventh transistor with a control terminal receiving a first bias potential and an eighth transistor with a control terminal receiving a second bias potential, the seventh and eighth transistors being of mutually opposite channel types, the seventh and eighth transistors being connected in parallel to the node at which the second transistor and the first current mirror are interconnected in the differential input stage; and the second current pass circuit includes a ninth transistor with a control terminal receiving the first bias potential and an tenth transistor with a control terminal receiving the second bias potential, the ninth and tenth transistors being of mutually opposite channel types, the ninth and tenth transistors being connected in parallel to the node at which the first transistor and the first current mirror are interconnected in the differential input stage.

6. The driving voltage output circuit of claim 1, wherein:

in the high-side voltage followers the first, second, and sixth transistors are n-channel field effect transistors and the third, fourth and fifth transistors are p-channel field effect transistors; and in the low-side voltage followers the first, second, and sixth transistors are p-channel field effect transistors and the third, fourth and fifth transistors are n-channel field effect transistors.

7. The driving voltage output circuit of claim 1, wherein the current output element is a current source supplying a substantially constant current.

8. The driving voltage output circuit of claim 1, wherein the current output element further comprises an eleventh transistor having a control terminal receiving the third potential, the third transistor and the eleventh transistor being of mutually different conductive types, the third transistor and the eleventh transistor being connected in a push-pull configuration.

* * * * *